US006285387B1

(12) United States Patent
Ueno et al.

(10) Patent No.: US 6,285,387 B1
(45) Date of Patent: Sep. 4, 2001

(54) RECORDING DEVICE

(75) Inventors: Kenji Ueno, Kofu; Tatsuo Mochizuki, Yamanashi-ken; Takehito Kobayashi, Nirasaki, all of (JP)

(73) Assignee: Nisca Corporation, Yamanashi-ken (JP)

( * ) Notice: Subject to any disclaimer, the term of this patent is extended or adjusted under 35 U.S.C. 154(b) by 0 days.

(21) Appl. No.: 09/460,656

(22) Filed: Dec. 13, 1999

(30) Foreign Application Priority Data

Aug. 31, 1999 (JP) ..... 11-244411

(51) Int. Cl.[7] ..... B41J 2/325
(52) U.S. Cl. ..... 347/222
(58) Field of Search ..... 347/215, 218, 347/197, 222; 400/120.16, 120.17, 120.18; B41J 25/34

(56) References Cited

U.S. PATENT DOCUMENTS 5,825,392 * 10/1998 Mochizuki ..... 347/197

FOREIGN PATENT DOCUMENTS 09-131944 * 5/1997 (JP) .
11-147348 * 6/1999 (JP) .

* cited by examiner

*Primary Examiner*—N. Le
*Assistant Examiner*—K. Feggins
(74) *Attorney, Agent, or Firm*—Pitney, Hardin, Kipp & Szuch LLP

(57) ABSTRACT

Replaceable ink ribbon cartridge and thermal head unit are incorporated in a recording device in such a state that they can be attached into and detached from a printing position defined in the recording device through a front opening formed in the front of the recording device. The thermal head unit with a thermal printing head is movable back and forth toward a thermal-transfer ink ribbon contained in the ink ribbon cartridge in a direction perpendicular to a card transfer passage along which a recording medium such as a card is fed to a recording station. The ink ribbon cartridge and thermal head unit mounted in the device can be taken out perpendicularly to the direction in which the thermal head unit moves toward the card transfer passage, so that they can be replaced from the front of the recording device, thus rendering handling of the device easy.

10 Claims, 8 Drawing Sheets

RECORDING DEVICE

BACKGROUND OF THE INVENTION

1. Field of the Invention

This invention relates to a recording device for recording or printing various information such as images and letters on a card used as a recording medium by use of a replaceable ink ribbon cartridge containing a thermal-transfer ink ribbon, and more particularly to a recording device capable of allowing not only an ink ribbon cartridge but also a thermal printing head to be easily mounted into and demounted from the front of the device so as to insure ease of handling.

2. Description of the Prior Art

Into a thermal-transfer printer serving as a recording device for recording information such as letters and images on a card base of a credit card, license card, ID card or the like, an ink ribbon cartridge containing an expendable thermal-transfer ink ribbon is mounted replaceably.

The ink ribbon cartridge mounted in a conventional printer of this kind is generally replaced by opening an upper or front cover of the printer in various manners according to the type or structure of the printer. Such a cover is pivoted openably on the printer in order to easily take out the cartridge.

Infrequently, there has been a need for replacing a thermal printing head for effecting thermal-transfer printing due to damage or wear of the thermal printing head, but the thermal printing head could not easily be taken out from the recording device.

In order for moving the thermal printing head back and forth toward a card base during the process of recording information on the card base, the thermal printing head is usually united with a complicated head moving mechanism, and therefore, could not easily be disconnected from the head moving mechanism and taken out of the printer. That is, prior to taking out the thermal printing head from the printer, the head moving mechanism must be demounted from the printer.

There has been proposed a printer system capable of relatively easily replacing a thermal printing head in, for example, Japanese Patent Application Publications Nos. HEI 9-131944(A) and HEI 11-147348(A). The printer system so far proposed is provided with a head moving mechanism capable of being separated by opening upwardly an upper cover of the printer system in order to primarily take out the head therefrom.

This conventional head moving mechanism allows the thermal printing head to be easily taken out, but it disadvantageously adds to complexity of the printer system.

It is convenient to take out not only the ink ribbon cartridge but also the thermal printing head from the front side of the printer system, since the printer system having a front lid provided for taking in and out the printing head has little restrictions as to the surrounding space of the printer system. The printer system capable of demounting both the ink ribbon cartridge and thermal printing head from the front of the printer can conveniently be incorporated into any other device with ease and becomes easy to handle.

Thus, there has conventionally been a printer capable of demounting the printing head and the ink ribbon cartridge from the upper portion of the printer by opening the upper cover or lid of the printer, but there has been no contrivance capable of taking out the thermal printing head from the front of the printer. That is to say, the thermal printing head in the conventional thermal printer can be taken in and out in the direction in which the printing head moves back and forth toward the card placed on a platen roller at a recording position, but it is impossible to extract the thermal printing head perpendicular to the aforesaid direction in which the printing head moves back and forth toward to the card. In this manner, the conventional thermal printer capable of taking out the ink ribbon cartridge from the front of the printer irrationally necessitate an opening operation of the upper cover or lid of the printer to take in and out the printing head.

Even if the conventional thermal printer capable of taking out the ink ribbon cartridge from the front of the printer has a structure of enabling the thermal printing head to be taken out from the front of the printer, a mechanism for correctly and stably remounting the thermal printing head to a prescribed position within the printer is required, but it was thought of as difficult or impossible.

OBJECT OF THE INVENTION

An object of the present invention is to provide a recording device easy to handle, having a demountable ink ribbon cartridge and a demountable thermal printing head, which can be taken in and out from the front of the device.

Another object of the invention is to provide a recording device capable of allowing the ink ribbon cartridge to be independently attached into and detached from the device through the front of the device without demounting a thermal printing head.

Still another object of the invention is to provide a recording device with a mechanism having convenient functions of allowing a demountable ink ribbon cartridge and a demountable thermal printing head, which can be taken in and out through the front of the device and accurately secured in position within the device so as to effect printing of high quality.

SUMMARY OF THE INVENTION

To attain the objects described above according to the present invention, there is provided a recording device comprising an ink ribbon cartridge with a thermal-transfer ink ribbon, which is demountably secured at a printing position in the device, a thermal head unit with a thermal printing head, which is movable back and forth toward the ink ribbon so as to come in contact with a recording medium through the ink ribbon to effect printing on the recording medium, and a head holder for demountably securing the thermal head unit at the printing position so as to allow the thermal head unit to be attached to and detached from the device perpendicularly to the direction in which the thermal head unit moves back and forth toward the ink ribbon.

A card to be printed with desired information is fed toward a recording station defined in the printing position within the device along a card transfer passage. The card transfer passage having the recording station defined thereon is formed in a strip-like orthogonal plane relative to the direction in which the thermal head unit is fed toward recording station.

The ink ribbon cartridge has a printing window for exposing the ink ribbon contained in the cartridge. The thermal head unit moves to and fro toward the ink ribbon exposed in the printing window of the cartridge so as to come in contact with the recording surface of the card passing through the recording station through the ink ribbon.

When the recording device is at rest, the thermal head unit assumes its rest position separated from the printing window of the cartridge so as to allow the ink ribbon cartridge to be taken out from the front of the device.

The head holder for holding the thermal head unit to place the printing head opposite to the recording station includes a head supporting member for the thermal head unit so as to allow the thermal head unit to slidably move from the printing position in the device toward the front of the device in the direction perpendicular to that in which the printing head moves toward the recording station during the course of printing, and a head moving mechanism for moving the thermal head unit held by the head supporting member back and forth toward the recording station.

The thermal head unit thus detachable from the front of the device can easily be replaced and maintained in good condition.

Other and further objects of this invention will become obvious upon an understanding of the illustrative embodiments about to be described or will be indicated in the appended claims, and various advantages not referred to herein will occur to one skilled in the art upon employment of the invention in practice.

DESCRIPTION OF THE PREFERRED EMBODIMENTS

The recording device according to this invention incorporates a demountable ink ribbon cartridge with a thermal-transfer ink ribbon used for printing information on a recording medium and a demountable thermal head unit with a replaceable thermal-transfer printing head. Specifically, the recording device enjoys an advantage in that both the ink ribbon cartridge and thermal head unit can be taken out from the front of the recording device so as to render handling of the device easy.

Figure 1:
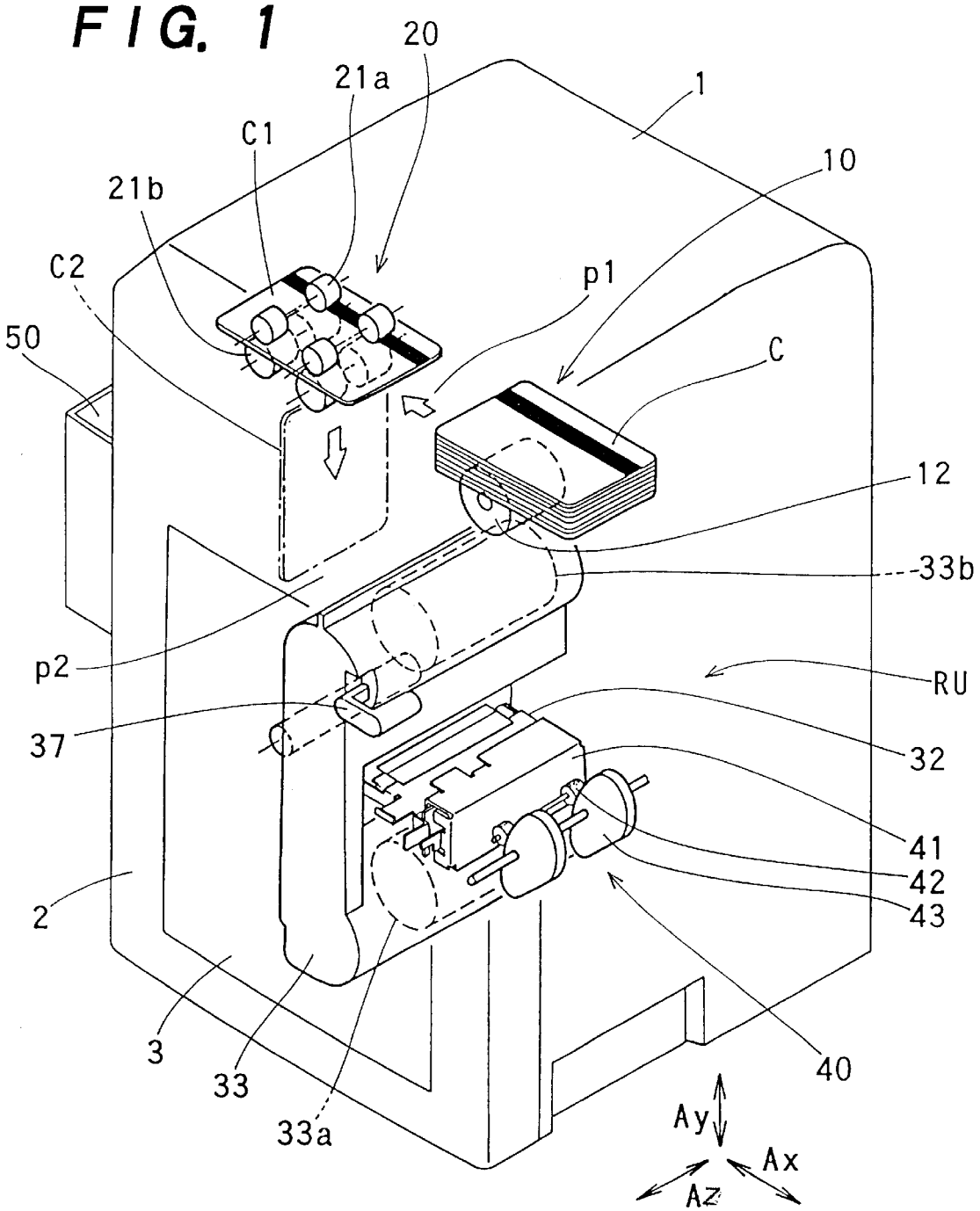
FIG. 1 is a schematic sec-through view in perspective of one embodiment of a recording device having a thermal head unit detachable from the front of the recording device according to this invention.
Figure 2:
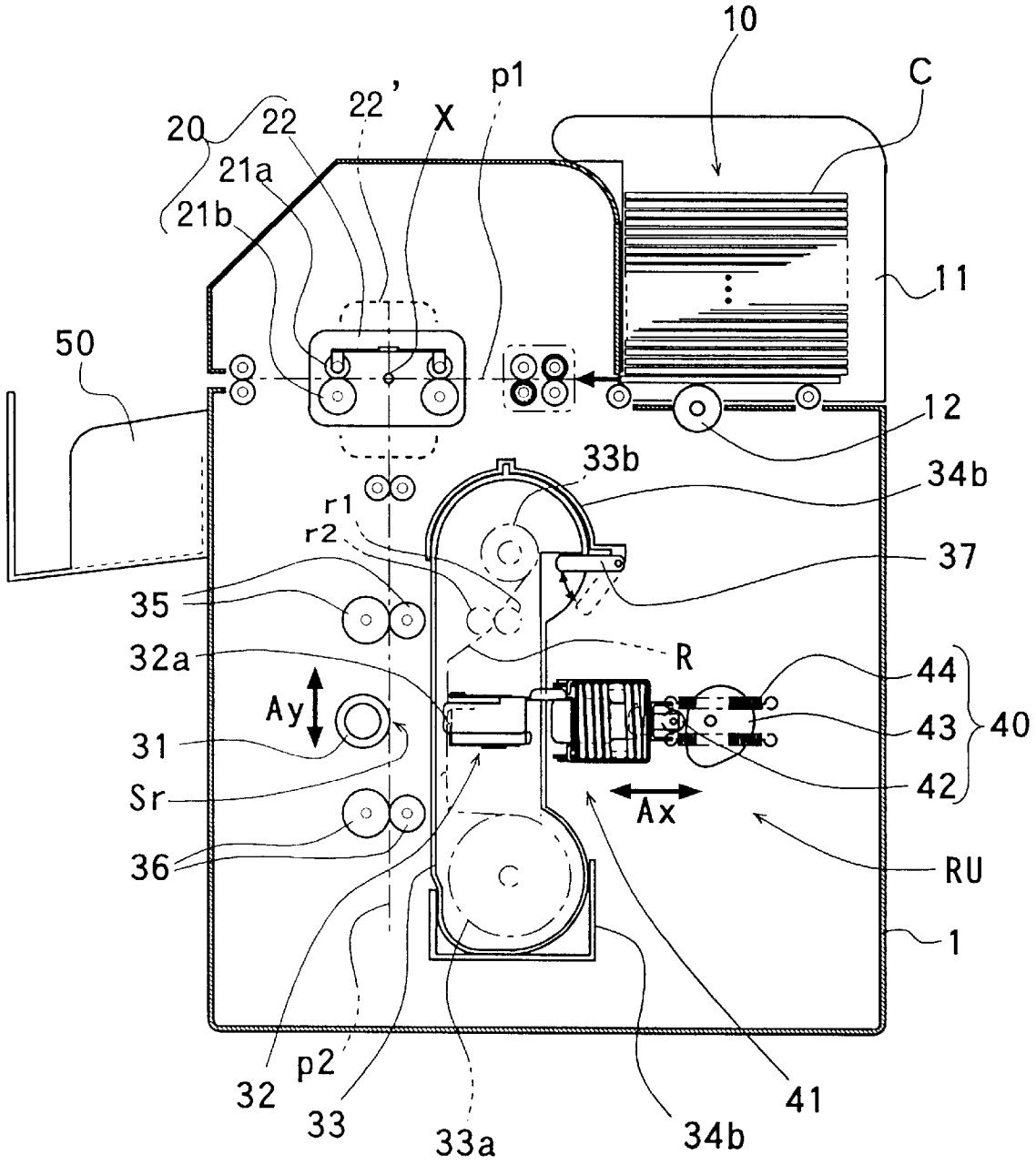
FIG. 2 is a schematic front view showing the card recording device of FIG. 1.
Figure 3:
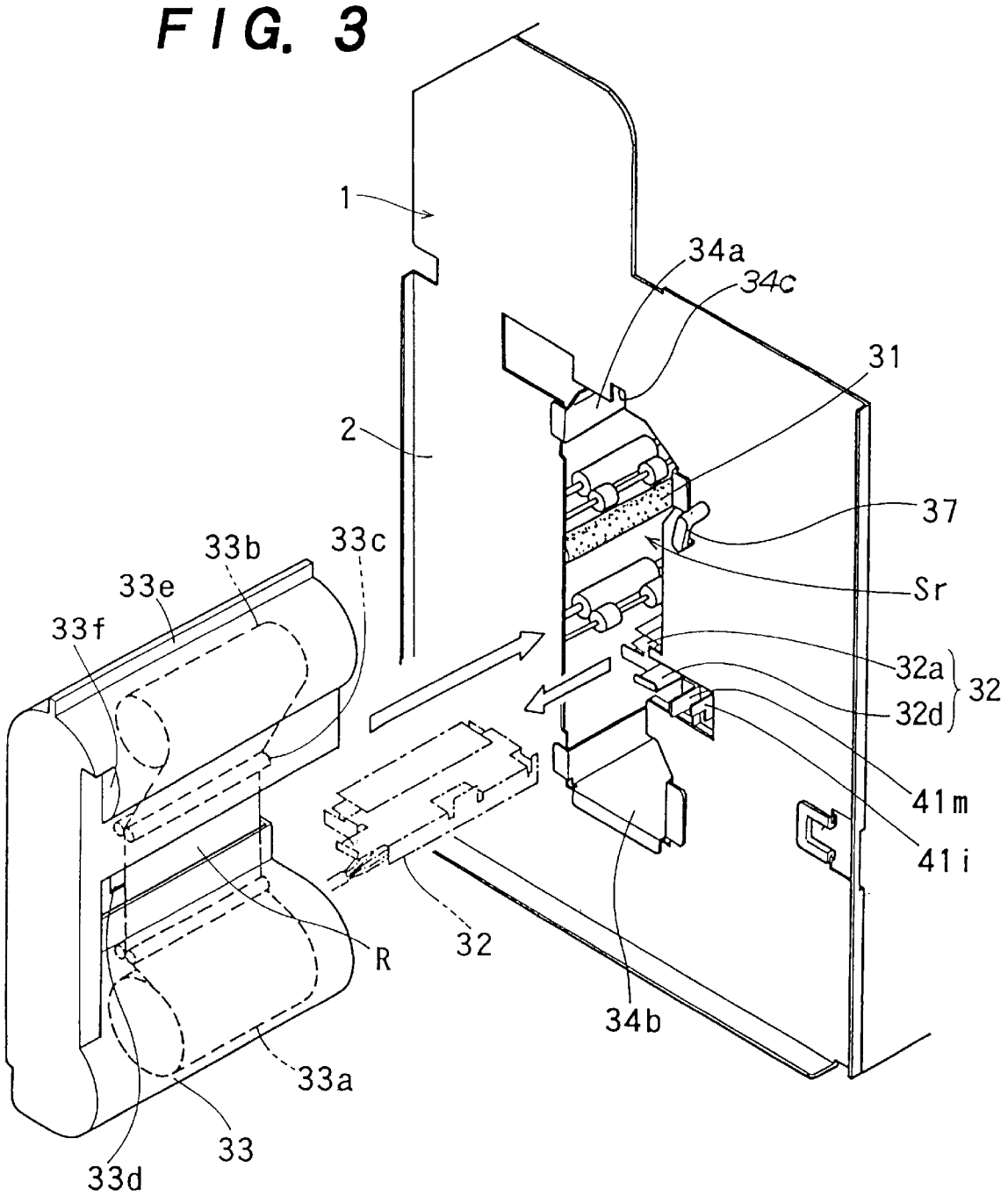
FIG. 3 is a schematic perspective view showing the manner in which the ink ribbon cartridge and thermal head unit are being attached into the recording device according to the invention.

As illustrated in FIG. 1 and FIG. 2 as one example, the recording device of the invention comprises a first card transfer passage p1 arranged substantially horizontally in a device housing 1, a second card transfer passage p2 arranged substantially perpendicular to the first card transfer passage p1, i.e. substantially vertically, a card supply unit 10 for containing one or more blank cards (recording media) C and sending out the cards one by one to the first card transfer passage p1, a card turning means 20 located at the intersection X of the first and second card transfer passages p1 and p2, and an information recording unit RU for recording information on one or both of the surfaces of the card.

In the illustrated embodiment, the information recording unit RU is mounted in the recording device, being opposed to include a recording station Sr defined on the second card transfer passage p2. The recording device has a front opening formed in the front-side wall 2 of the housing 1 opposite to the recording station Sr. The opening in the front-side wall 2 is normally closed with a lid member 3. Thus, the detachable ink ribbon cartridge 33 and thermal head unit 32 mounted within the recording device can be taken out from the recording device through the front opening by opening the lid member 3.

Although the recording device in the illustrated embodiment has the intersecting first and second card transfer passages p1 and p2, this should not be understood as being limited thereto. That is to say, the invention is applicable to any other recording devices or printers having a single card transfer passage or three or more card transfer passages.

The card supply unit 10 includes a card stacker 11 for storing one or more blank cards C in a piled state, and a kick roller 12 disposed on the bottom of the card stacker 11 for sending out the cards C one by one to the first transfer passage p1. Namely, by rotating the kick roller 12, only the lowermost of the cards C stacked in the card stacker 11 is sent out to the first card transfer passage p1.

The card turning means 20 located at the intersection X of the first and second card transfer passages p1 and p2 has functions of not only transferring the card between the first and second passages p1 and p2, but also turning over the card to effect printing on one or both of the surfaces of the card.

The card turning means 20 in this embodiment includes pinch rollers 21*a* and 22*a* for moving and holding the card therebetween, and a turning frame 22 rotatable about the intersection X of the first and second card transfer passages p1 and p2.

The paired pinch rollers 21*a* and 21*b* are supported by the turning frame 22 so as to come in frictional contact with each other on the first card transfer passage p1 when the turning frame 22 assumes its horizontal posture as shown by the solid line in FIG. 2, and on the second card transfer passage p1 when the turning frame 22 assumes its vertical posture as shown by the dotted line 22'. One of the pinch rollers 21*a* and 21*b* is a driving roller, and the other pinch roller is a driven roller.

The pinch rollers 21*a* and 21*b* may be driven in synchronism with the rotation of the turning frame 22 by using a single driving system such as a motor (not shown). In the case of synchronously driving the pinch rollers 21*a* and 21*b* and the turning frame 22 by use of the single driving system, when the turning frame is rotated around the intersection X of the passages p1 and p2 in the state of holding the card between the paired pinch rollers 21*a* and 21*b*, the card held between the pinch rollers 21*a* and 21*b* rotating in synchronism with the turning frame 22 is inevitably moved by the rotating pinch rollers, consequently to displace the card from the center of the turning frame 22. To prevent the card from being displaced, it is desirable to cause the pinch rollers 21*a* and 21*b* to rotate at the same speed in the opposite direction to that in which the turning frame 22 turns. It is a matter of course that the pinch rollers 21*a* and 21*b* may be driven by another driving system independent of that for turning the turning frame 22.

The characteristic information recording unit RU includes a platen roller 31 located at the recording station Sr defined on the second card transfer passage p2, and a head moving mechanism 40, in addition to the aforementioned thermal head unit 32 which is moved back and forth toward the platen roller 31 by means of the head moving mechanism 40, and the ink ribbon cartridge 33 containing the thermal-transfer ink ribbon R as touched upon above. The thermal head unit 32 is provided with a thermal printing head 32*a*, and a head supporting member 32*b*. Along the second card transfer passage p2, there are disposed transfer rollers 35 and 36 for moving the card through the recording station Sr.

On the opposite end of the first card transfer passage p1 relative to the card supply unit 10, there is disposed a finished-card discharge unit 50 for sending out thereto the finished card recorded with desired information such as various images.

In the illustrated embodiment, the direction of moving the card along the second card transfer passage p2 is referred to as "Ay", the direction perpendicularly across the direction Ay, in which the thermal head unit 32 moves back and forth toward the recording station Sr, is referred to as "Ax", and the direction perpendicular to both the directions Ay and Ax, in which the ink ribbon cartridge 33 and thermal head unit 32 are mounted and demounted, is referred to as "Az", for the convenience of description.

The ink ribbon R contained in the ink ribbon cartridge 33 is sent out from a ribbon supply reel 33*a* and rewound around a ribbon take-up reel 33*b* through the recording station Sr. The feeding of the ink ribbon R is controlled by ribbon feed rollers r1 and r2. One of the ribbon feed rollers 33 is a driving roller, and the other is a driven roller. It is preferable that the ribbon feed roller r2 being in contact of the front surface of the ink ribbon, which front surface is coated with the ink layer, is the driven roller, and the ribbon feed roller r1 being in contact of the reverse surface having no ink layer of the ink ribbon opposite to the ink-layer coated surface, is the driving roller. By positively feeding the ink ribbon R by the driving roller r1 being in contact with the surface having no ink layer, the ink ribbon can be fed without inflicting too much injury to the ink layer coated, which faces the side of the driven roller. Consequently, printing quality is little deteriorated when feeding the ink ribbon using the rotating feeding rollers.

The ink ribbon cartridge 33 has a printing window 33*d* formed between the ribbon supply reel 33*a* and the ribbon take-up reel 33*b* to allow the ink ribbon R to be exposed and opposed to the platen roller 31 at the recording station Sr.

When executing printing of information such as letters or images on the card moving along the second card transfer passage p2, the printing head 32*a* of the thermal head unit 32 is brought into contact with the recording surface of the card through the ink ribbon R exposed in the printing window 33*c* of the cartridge 33, while selectively driving the respective heating elements of the printing head 32*a* to heat the heating elements. Consequently, the thermal transfer ink applied to the ink ribbon R is thermally transferred to the recording surface of the card to depict a desired image on the card.

The recording device has upper and lower guide members 34*a* and 34*b* extending from the front-side wall 2 of the housing 1 to the inside of the recording device in the direction Az, so that the ink ribbon cartridge 33 can be demounted from or remounted into the printing position defined in the recording device along the upper and lower guide members 34*a* and 34*b*. The ink ribbon cartridge 33 is provided with a positioning protrusion 33*e* so as to be correctly inserted along a positioning groove 34*c* formed in the upper guide member 34*a* and set in the prescribed printing position in the recording device with ease. The upper and lower guide members 34*a* and 34*b* extend from the front-side wall 2 toward the back of the recording device in the direction Az substantially perpendicular to the front-side wall 2, so that the ink ribbon cartridge 33 can be taken out from the front of the recording device.

To steadily secure the ink ribbon cartridge 33 at the prescribed printing position in the recording device, there are a lock lever 37 disposed on the recording device, and a lock dent 33*f* formed in the ink ribbon cartridge 33, so that the lock lever 37 interlocks with the lock dent 33*f* as shown in FIG. 2, when completely inserting the ink ribbon cartridge 33 into the prescribed printing position in the recording device. The ink ribbon cartridge 33 is stably secured in the printing position by these lock mechanism of the lock lever 37 and lock dent 33*f*, and can be taken out from the printing position by unlocking the lock lever 37 as shown by the dotted line in FIG. 2.

The head moving mechanism 40 for moving the thermal head unit 32 back and forth toward the platen roller 31 located at the recording station Sr includes a head holder 41 for demountably holding the thermal head unit 32, a follower roller 42 disposed on the head holder 41, a non-circular rotating cam 43 being in contact with the follower roller 42, and springs 44 for bringing the head holder 41 into contact with the cam 43. By rotating the cam 43, the head holder 41 with the thermal head unit 32 is moved back and forth toward the recording station Sr.

The head holder 41 comprises a box-like frame 41*a*, springs 41*b* disposed within the frame 41*a*, and a push member 41*c* urged toward the printing head by the springs 41*b*. The frame 41*a* includes support pieces 41*d* for movably supporting the push member 41*c*, guide pins 41*e* each fixed on the support pieces 41*d*, engaging claws 41*f* for retaining the thermal head unit 32, a pushing wall 41*h* on which the cam 43 is seated rotatably, a finger hook 41*i* protruding laterally from the side of the frame, and slide pieces 41*j* extending in parallel with the support pieces 41*d*.

The push member 41*c* movably disposed within the frame 41*a* is provided at one side end with a finger piece 41*m* opposite to the finger hook 41*i* formed on the side of the frame 41*a* and at the other side end with a stopper 41*n*. Thus, the push member 41*c* is urged by the springs 41*b* to be brought into press contact with the engaging claws 41*f* under a normal condition, but can be separated from the engaging claws 41*f* by pushing the finger piece 41*m* toward the finger hook 41*i* against the urging force of the springs 41*b* with fingers.

The head supporting member 32*b* for enabling the thermal head unit 32 to be mounted on and demounted from the frame 41*a* has an engaging plate 32*c* to be held between the engaging claws 41*f* of the frame 41*a* and the push member 41*c*, and a pull tongue 32*d* for use in pulling out the head unit 32 from the device housing. The head supporting member 32*b* is detachably held in the space defined among the engaging claws 41*f*, slide pieces 41*j* placed on the support piece 41*d*, and push member 41*c* in the state removable in the longitudinal direction (direction Az) of the thermal printing head 32*a*.

Figure 4A:
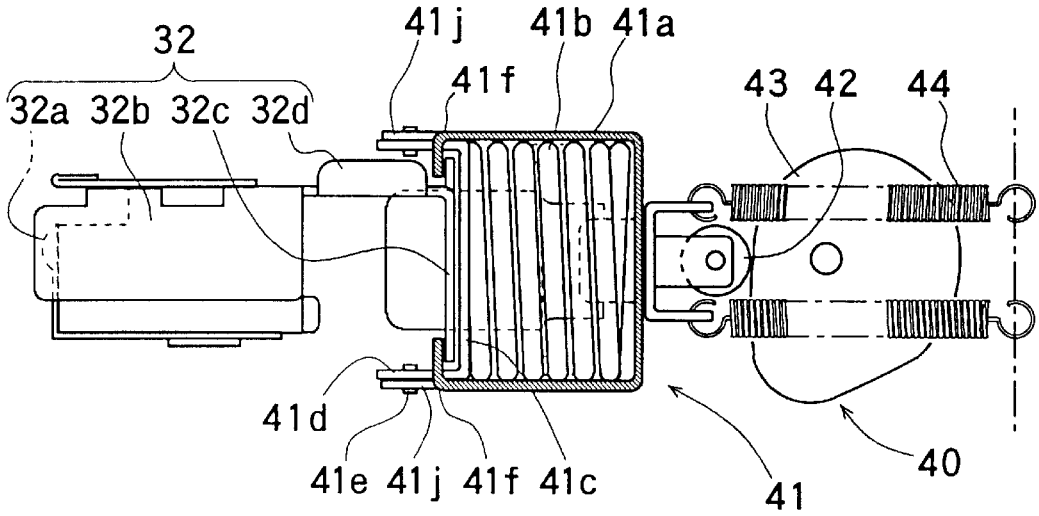
FIG. 4A and FIG. 4B are schematic front views showing the ink ribbon cartridge and thermal head unit are secured by the head holder of the recording device according to the invention.
Figure 4B:
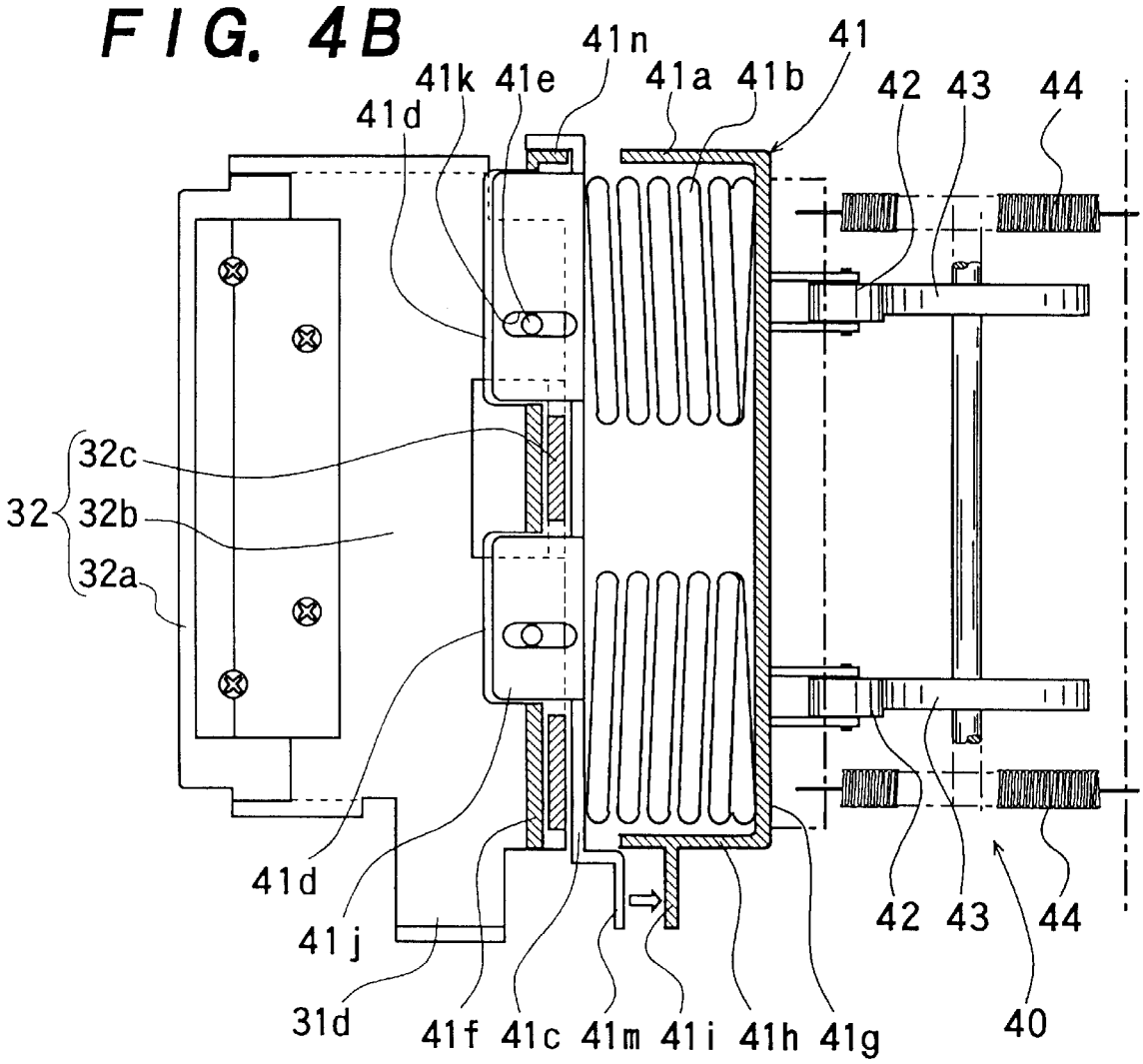
Figure 6:
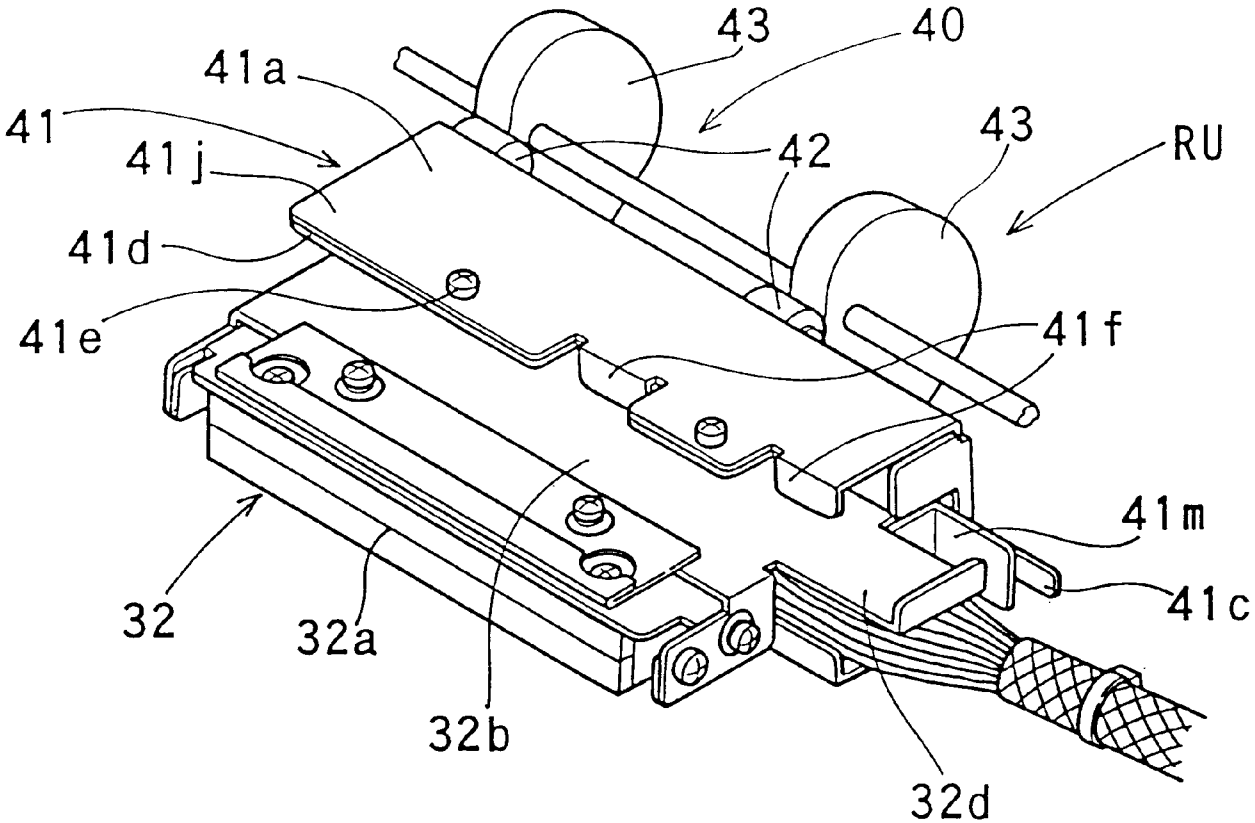
FIG. 6 is a schematic perspective view showing the state of uniting the thermal head unit with the head moving mechanism in the device of the invention.
Figure 7:
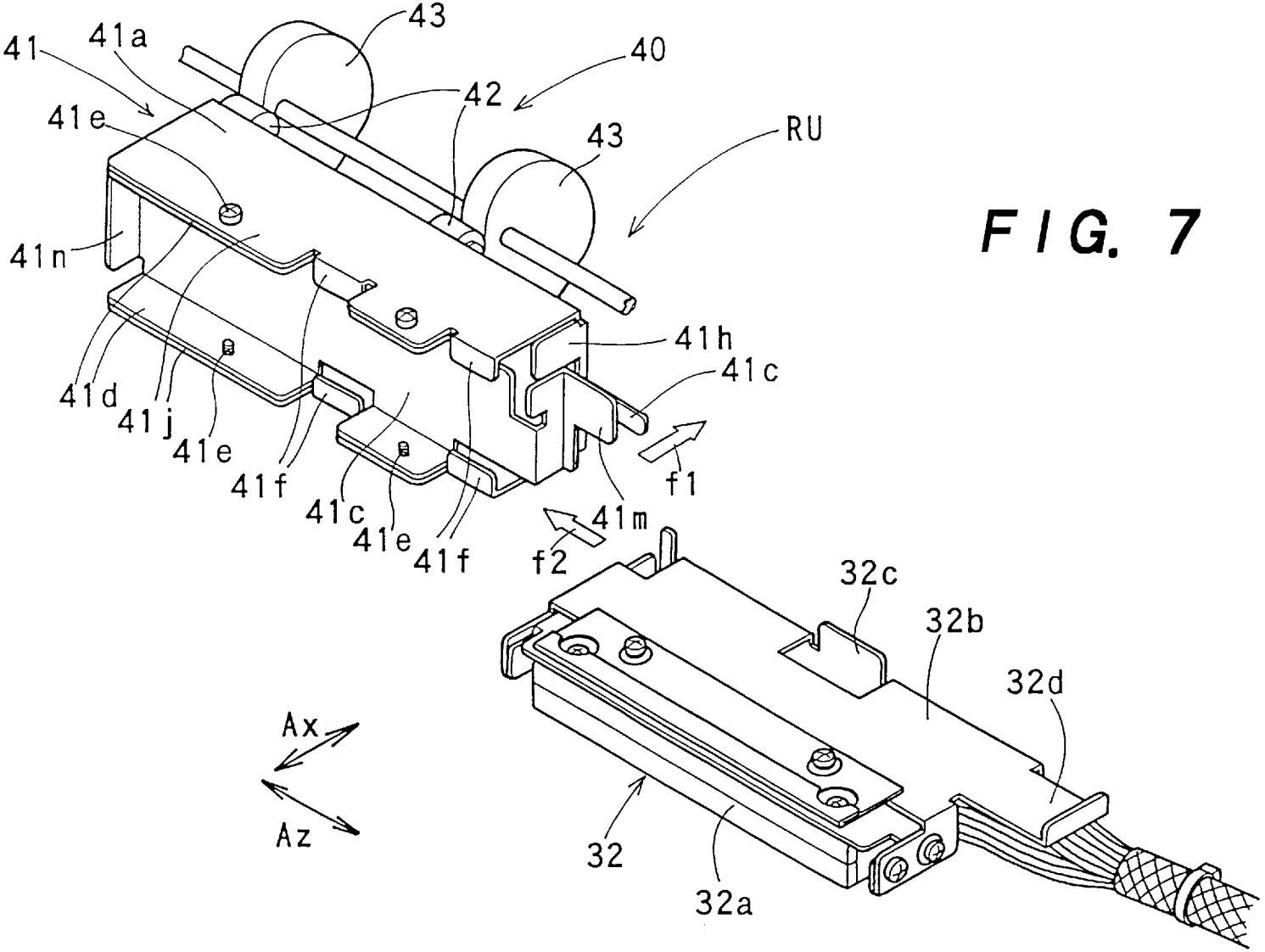
FIG. 7 is a schematic perspective view showing the state of separating the thermal head unit from the head moving mechanism in the device of the invention.

FIG. 6 and FIGS. 4A and 4B show the state in which the thermal head unit 32 attached to the head holder 41 by means of the head supporting member 32*b* is secured at the prescribed head holding position defined in the recording device. FIG. 7 shows the state in which the thermal head unit 32 is separated from the head holder 41.

In the state of uniting the thermal head unit 32 with the head holder 41, the push member 41*c* is urged toward the engaging claws 41*f* by the springs 41*b* to firmly hold the engaging plate 32*c* between the push member 41*c* and the engaging claws 41*f* as shown in FIG. 6.

Figure 5A:
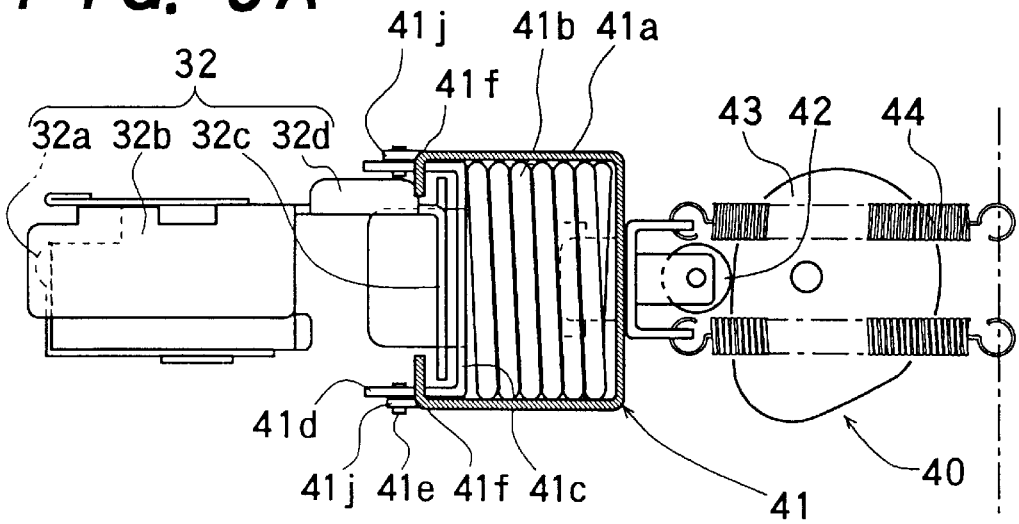
FIG. 5A and FIG. 5B are schematic front views showing the state of unlatching the head holder to release the ink ribbon cartridge and thermal head unit in the recording device according to the invention.
Figure 5B:
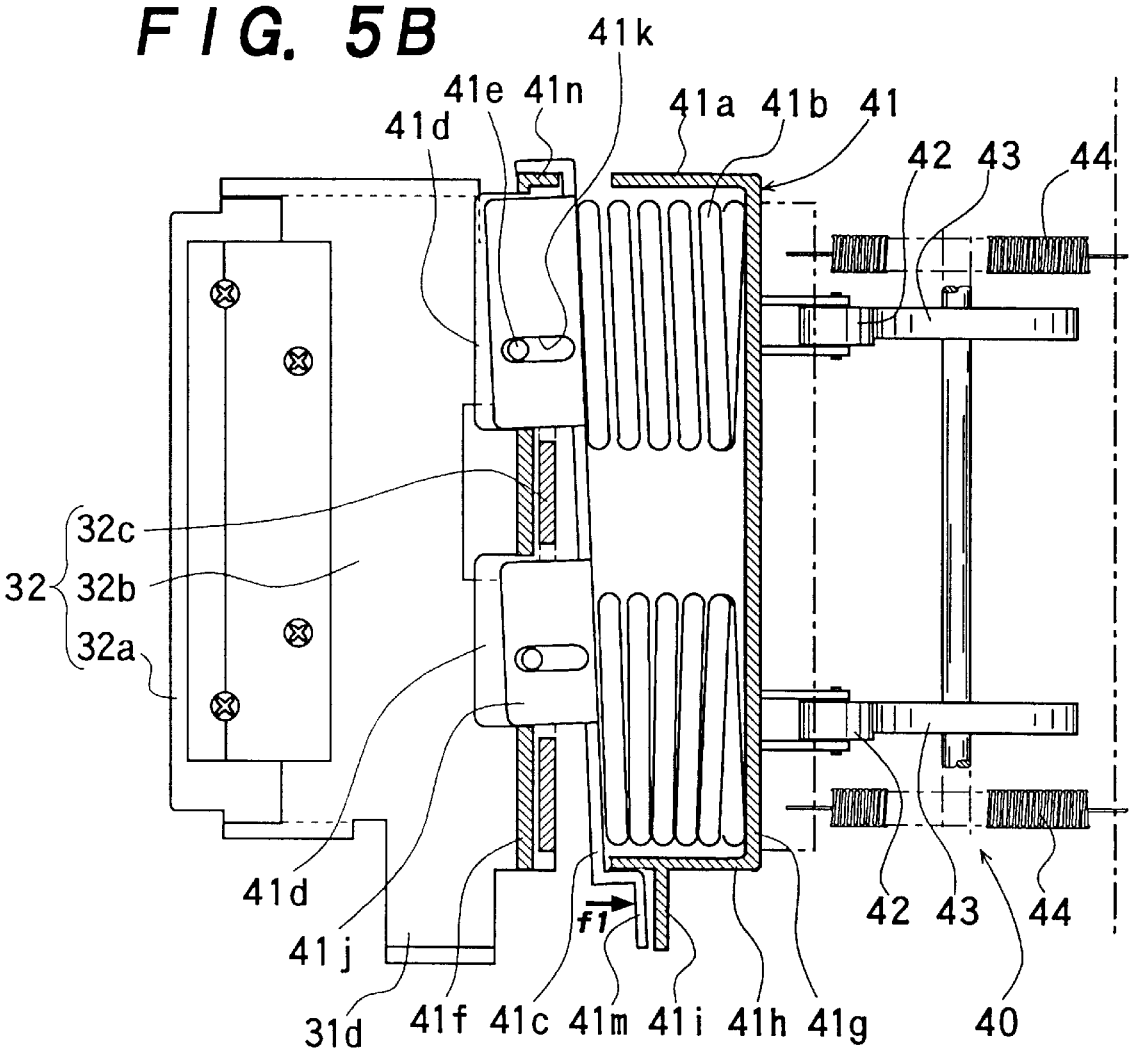

When removing the thermal head unit 32 from the head moving mechanism 40, that is, demounting the unit 32 from the head holding position in the recording device, the push member 41*c* is first separated from the engaging claws 41*f* by pinching the finger piece 41*m* and finger hook 41*h* with fingers against the springs 41*b* as shown by the arrow f1 in FIGS. 5B and 7. As a result, the space between the push member 41*c* and the engaging claws 41*f* is widened to allow the engaging plate 32*c* of the thermal head unit 32 to be pulled out. In the state of making the engaging plate 32*c* free between the push member 41*c* and the engaging claws 41*f*, the head unit 32 can be taken out from the recording device by pulling the pull tongue 32*d*.

Remounting of the demounted head unit 32 or another head unit into the head holding position in the recording device can be carried out by reversing the procedures mentioned above. That is to say, while pinching the finger piece 41*m* and finger hook 41*i* to make the space therebetween wide as shown by the arrow f1 in FIG. 5B and FIG. 7, the thermal head unit 32 is inserted into the widened space between the push member 41*c* and engaging claws 41*f* as shown by the arrow f2 in FIG. 7. When the tip end of the thermal head unit 32 collides with the stopper 41*n*, the finger piece 41*m* is released to render the push member 41*c* to press the engaging plate 32*c* against the engaging claws 41*f* by the action of the springs 41*b* as shown in FIGS. 4A and 4B and FIG. 6. Thus, the thermal head unit 32 is firmly secured exactly in position in the space defined among the stopper 41*n*, engaging claws 41*f* and push member 41*c*.

In the manner as described above, the thermal head unit 32 can easily be taken off from the front side of the recording device in the direction Az perpendicular to the direction Ax in which the thermal head unit 32 moves back and forth in the printing operation. Besides, the thermal head once demounted can easily be inserted into the head holding position defined in the recording device and firmly secured in position with high accuracy, consequently to achieve high precision in printing.

Figure 8A:
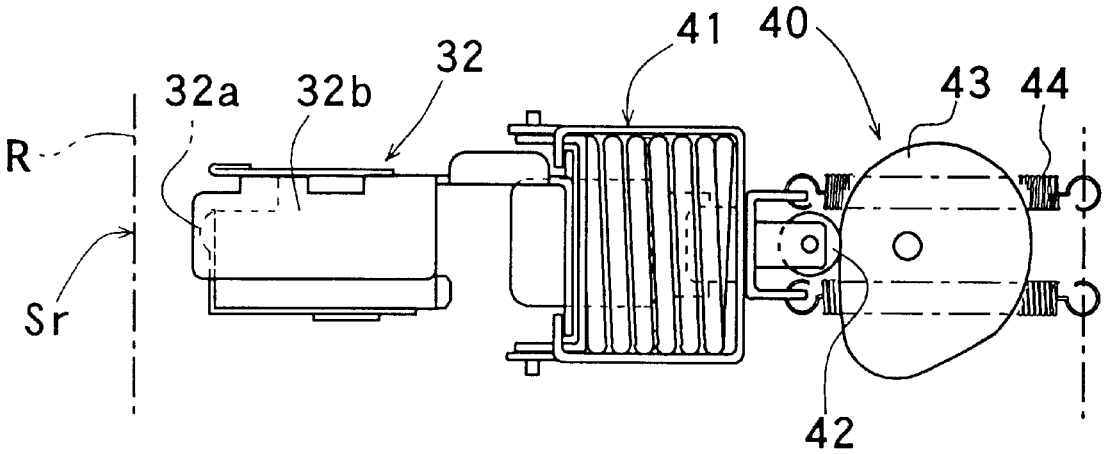
FIGS. 8A, 8B and 8C are front views showing the rest state, standby state and printing state of the thermal printing head of the invention.
Figure 8B:
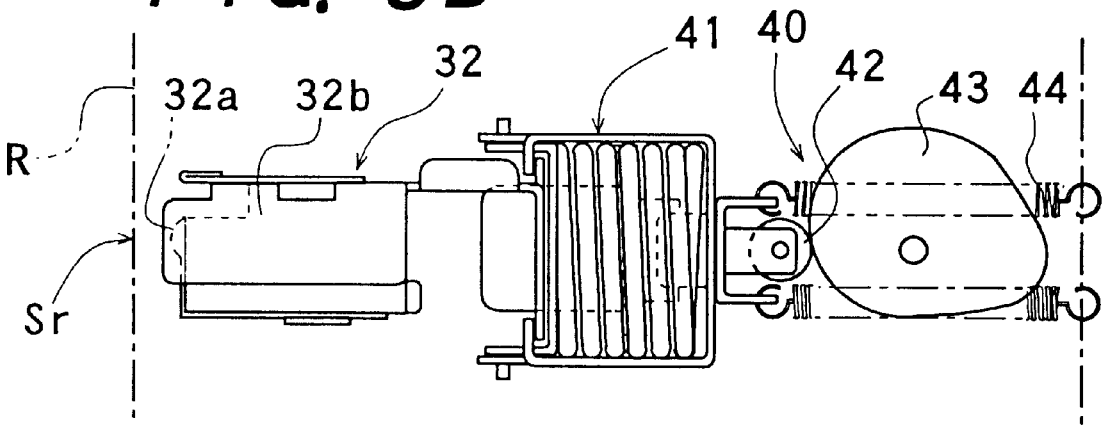
Figure 8C:
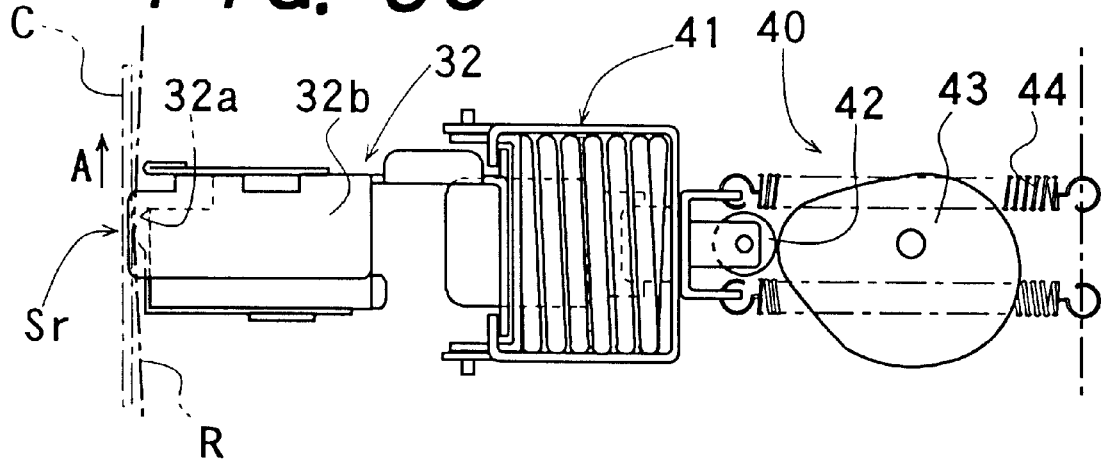

The thermal head unit 32 secured at the holding position defined in the recording device assumes one of three operating states, i.e. the rest state in which the thermal printing head 32*a* is separated from the the recording station Sr and ink ribbon R as shown in FIG. 8A, the standby state in which the thermal printing head 32*a* approaches the ink ribbon R to stand ready for printing at the position close to the recording station Sr as shown in FIG. 8B, and the printing state in which the thermal printing head 32*a* comes in contact with the recording medium such as a card C through the ink ribbon R as shown in FIG. 8C.

By controlling the rotation of the cam 43 of the head moving mechanism 40, the thermal head unit 32 can selectively be brought into one of the aforementioned states.

In the rest state of the thermal head unit 32, each cam 43 rotates to bring its smallest diameter part into contact with the follower roller 42, so that the thermal printing head 32*a* is separated away from the recording station Sr and the ink ribbon R exposed in the printing window 33*c* of the cartridge 33, as shown in FIG. 8A. In this state, the ink ribbon cartridge 33 can be pulled out to be demounted from the recording device without being disturbed by the thermal head unit 32.

In the standby state described above, the cam 43 brings its middle diameter part into contact with the follower roller 42, consequently to cause the thermal printing head 32*a* to approach the ink ribbon R exposed in the printing window 33*c* of the cartridge 33, so that the thermal printing head 32*a* can be in contact with the ink ribbon R in the printing window 33*c* as quick as instructions to effect printing are given to the recording device, as shown in FIG. 8B.

In the printing state of making the thermal printing head print information on the recording medium, the cam 43 brings its largest diameter part into contact with the follower roller 42 as shown in FIG. 8C, consequently to bring the thermal printing head 32*a* into press contact with the recording medium placed at the recording station Sr through the ink ribbon R while selectively operating each of the heating elements of the thermal printing head 32*a* to heat the thermal-transfer ink ribbon R. As a result, the desired information such as letters and images is reproduced on the recording medium.

During the course of printing, the ink ribbon R and the card C move at the same speed in the direction shown by the arrow "A" in FIG. 8C relative to the thermal printing head 32*a*. After the card completely passes through the recording station Sr to finish the printing, the thermal printing head 32*a* returns to the standby state as shown in FIG. 8B. When the next recording medium is required to be processed subsequently, the thermal printing head 32*a* moves to the recording station Sr to assume its printing state as shown in FIG. 8C. Namely, as long as the printing process is repeated without need for demounting the ink ribbon cartridge 33 or the thermal head unit 32, the same procedure of moving the thermal head unit 32 between the standby position of FIG. 8B and the printing position of FIG. 8C is repeated.

In the recording device of the invention, the ribbon take-up reel 33*b* may be driven by a driving source for rotating the cams 43, though it is not shown in the drawings. That is, the recording device of the invention can be operated with a single motor for driving the ribbon take-up reel 33*b* and the cams 43.

To perform the printing of information on the card C with the thermal transfer printer of the information recording unit RU, the card is fed from the card supply unit 10 along the first card transfer passage p1 as shown by symbol c1 in FIG. 1, and thereafter, turned 270 degrees or 90 degrees at the intersection X of the passages p1 and p2 by the turning means 20, and then, sent toward the recording station Sr on the second card transfer passage p2 as shown by symbol c2 in FIG. 1.

Thus, since the card can be turned at arbitrary angles, the printing of information can be carried out optionally on either or both of the surfaces of the card. The printing on both sides of the card can be performed by allowing the card, which has already been subjected to printing on one recording surface thereof at the recording station Sr, to be returned to the turning means 20 and then resent to the recording station Sr upon being turned 180 degrees with the turning means 20.

The finished card recorded with the desired information such as images at the recording station Sr is forwarded to the turning means 20, and then, turned 90 degrees or 270 degrees to assume its horizontal posture as shown by c1 in FIG. 1, and thereafter, discharged to the finished-card discharge unit 50 located at the downstream end of the first card transfer passage p1.

Although the first and second card transfer passages p1 and p2 intersect in order to make the device compact in the illustrated embodiment, this structure is not indispensable to this invention. The recording device of the invention may be composed of a single straight card passage, three or more card passages, or two card passages arranged one above another in parallel as seen in a conventional recording device.

As is described above, according to the present invention, since the replaceable thermal head unit with the thermal printing head can easily be taken out from the front side of the recording device as well as the replaceable ink ribbon cartridge, handling of the recording device becomes remarkably easy. Moreover, the recording device of the invention is efficient and convenient because the ink ribbon cartridge can easily be demounted from the device without removing the thermal head unit. Besides, the easily replaceable thermal head unit can be attached into the head holding position defined in the recording device from the front side of the device and securely held at the recording station with high accuracy. Thus, the recording device of the invention is easy to handle and can provide the high accurate recording or printing of various image information on the recording medium such as an ID card or the like.

As can be readily appreciated, it is possible to deviate from the above embodiments of the present invention and, as will be readily understood by those skilled in this art, the invention is capable of many modifications and improvements within the scope and spirit thereof. Accordingly, it will be understood that the invention is not to be limited by these specific embodiments, but only by the scope and spirit of the appended claims.

What is claimed is:

1. A recording device comprising an ink ribbon cartridge containing a thermal-transfer ink ribbon, said ink ribbon cartridge being demountably secured at a printing position defined in said recording device, a thermal head unit having a thermal printing head for thermally printing information on a recording medium while pressing the ink ribbon against the recording medium, said thermal head unit being movable back and forth toward said ink ribbon to come in contact with the recording medium through said ink ribbon when effecting printing on the recording medium, and a head holder fixed at a head unit holding position so as to secure said thermal head unit at the printing position and allowing said thermal head unit to be attached into and detached from said recording device perpendicularly to a direction in which said thermal head unit moves back and forth toward said ink ribbon, without moving, said head holder from said head unit holding position.

2. A recording device according to claim 1, wherein said thermal head unit and said ink ribbon cartridge are attachable to and detachable from the recording device having a front from the front of the device.

3. A recording device according to claim 1, wherein said thermal head unit secured at said printing position assumes one of a rest state in which said thermal printing head is separated from said recording station, a standby state in which said thermal printing head approaches said ink ribbon to stand ready for printing at a position close to said recording station, and a printing state in which said thermal printing head comes in contact with said recording medium through said ink ribbon.

4. A recording device comprising:

at least one card transfer passage having a recording station in a printing position, a device housing having a front-side wall with a front opening opposite to said printing position, an ink ribbon cartridge containing a thermal-transfer ink ribbon, said ink ribbon cartridge being attachable into and detachable from said printing position through said front opening, a thermal head unit with a thermal printing head for thermally printing information on a recording medium while pressing the ink ribbon against the recording medium, said thermal head unit being movable back and forth toward said recording station in a direction perpendicular to said card transfer passage to come in contact with the recording medium through said ink ribbon when effecting printing on the recording medium, a head holder for detachably securing said thermal head unit at the printing position and allowing said thermal head unit to be attached into and detached from said recording device perpendicularly to said direction in which said thermal head unit moves back and forth toward said recording station, and a head moving mechanism for moving said thermal head unit back and forth toward said recording station.

5. A recording device according to claim 4, wherein the direction in which said card transfer passage extends, the direction in which said thermal head unit moves back and forth toward said recording station, and the direction in which said thermal head unit is attached into and detached from said printing position in said device are perpendicular to one another.

6. A recording device according to claim 4, wherein said head moving mechanism includes a follower roller disposed on said head holder, a cam being in contact with said follower roller and rotatable to move said thermal head unit back and forth toward the recording station through the medium of said follower roller.

7. A recording device according to claim 6, further comprises a driving source for rotating said cam and feeding said ink ribbon contained in said ink ribbon cartridge.

8. A recording device according to claim 4, wherein said thermal head unit secured at said printing position assumes one of a rest state in which said thermal printing head is separated from said recording station, a standby state in which said thermal printing head approaches said ink ribbon to stand ready for printing at a position close to said recording station, and a printing state in which said thermal printing head comes in contact with said recording medium through said ink ribbon.

9. A recording device according to claim 8, wherein said head moving mechanism includes a follower roller disposed on said head holder, a cam being in contact with said follower roller and rotatable to move said thermal head unit back and forth through the medium of said follower roller.

10. A recording device according to claim 4, wherein said ink ribbon is coated on its one surface with thermal-transfer ink, and said ink ribbon cartridge includes a ribbon supply reel around which said ink ribbon is wound, a ribbon take-up reel for rewinding said ink ribbon fed from said ribbon supply reel, ribbon-feed driving and driven rollers for forwarding said ink ribbon from said ribbon supply reel to said ribbon take-up reel with said ribbon-feed driven roller being in contact with said surface coated with the thermal-transfer ink.

* * * * *